United States Patent [19]

Mori et al.

[11] Patent Number: 4,513,880

[45] Date of Patent: Apr. 30, 1985

[54] BILL RETENTION DEVICE

[75] Inventors: Yoshikazu Mori, Moroyama; Susumu Kojima; Osamu Kobayashi, both of Sakado, all of Japan

[73] Assignee: Kabushiki Kaisha Nippon Coinco., Tokyo, Japan

[21] Appl. No.: 409,017

[22] Filed: Aug. 17, 1982

[30] Foreign Application Priority Data

Aug. 24, 1981 [JP] Japan ..... 56-131462

[51] Int. Cl.[3] ..... B65H 5/28

[52] U.S. Cl. ..... 221/260; 221/71

[58] Field of Search ..... 221/71, 42, 260; 194/4 D, 4 C, 4 R, DIG. 26; 53/118

[56] References Cited

U.S. PATENT DOCUMENTS 4,337,864 7/1982 McLean ..... 194/4 R

*Primary Examiner*—Stanley H. Tollberg

*Attorney, Agent, or Firm*—Spensley Horn Jubas & Lubitz

[57] ABSTRACT

A bill retention device includes a relatively long guide belt which has one end thereof secured to a first rotary member and the other end to a second rotary member and is wound on the first rotary member when no bill isretained at all. For accommodating bills, the second rotary member is rotated to wind the guide belt and also wind the bills tightly thereon. In accordance with winding of the second rotary member, the guide belt is unwound from the first rotary member. Thus, the guide belt is finally wound on the second rotary member many times resulting in winding up of a large number of bills. By having the guide belt wound on the first rotary member simultaneously with the reverse rotation of the second rotary member, the retained bills are unwound from the second rotary member one by one whereby the bills can be automatically returned.

11 Claims, 9 Drawing Figures

BILL RETENTION DEVICE

BACKGROUND OF THE INVENTION

This invention relates to a bill retention device suitable for use in a bill acceptor used in a vending machine or a leasing machine which can be operated by a bill or in a bill delivery device.

A bill acceptor in a vending machine or leasing machine generally comprises a bill selection device and a bill stocker. The bill selection device automatically draws in a bill inserted from a bill inlet, discriminates a true bill from a false one, returns a false bill to the bill inlet and accepts a true bill. The bill stocker accommodates the bill accepted by the bill selection device. The known bill stocker stacks a newly deposited bill flatly on bills which have already been accommodated and stores a larger number of bills under pressure. While the known bill stocker can store a large number of bills, it has the disadvantage that the volume of the device tends to become large. This is because the mechanism for stacking bills flatly requires space which is the same as or larger than space in which bills can be stored, resulting in a bulky construction as a whole. Besides, this type of bill stocker is incapable of automatically returning the stored bills one by one and, accordingly, it can only function as a cash box and cannot be utilized as a bill escrow device.

SUMMARY OF THE INVENTION

It is therefore, an object of the invention to provide a compact bill retention device capable of accommodating a relatively large number of bills within space of a small volume.

It is another object of the invention to provide a bill retention device capable of readily and automatically returning a once retained bill thereby realizing a bill escrow device or a simple bill payout device by this novel bill retention device.

It is still another object of the invention to provide various advantageous devices which will enable once retained bills to be automatically returned or discharged.

The above described objects of the invention can be achieved by a bill retention device including a first rotary member having a winding drum and a guide belt secured at one end thereof to the winding drum and unwindably wound on the winding drum and a second rotary member disposed in parallel to the first rotary member having a winding drum and being capable of winding thereon the guide belt which is secured at another end thereof to the winding drum of the second rotary member, bills being would on the second rotary member with the guide belt as the second rotary member is rotated and being retained in a state in which the bills are wound about the second rotary member with the guide belt. Since the guide belt is sufficiently long to be wound many times around the second rotary member, a large number of bills can be wound on the second rotary member with the guide belt. According to the invention, bills are retained in a wound up state so that the volume of the entire device can be made smaller than the prior art bill stocker in which bills are stored in a stacked state. Besides, since the operation mechanism for receiving bills is only a rotational movement, the construction of the device can be simplified. Further, since the retained bills can be fed out one by one by reversely rotating the second rotary member, the bills which have once been accepted can be returned automatically and extremely easily.

A motor is provided for driving the second rotary member and bills are wound on the second rotary member with the guide belt. A sensor for detecting a bill is provided in a guide path provided for introducing bills forwarded from outside into the interior of the bill retention device and the motor is controlled by the output signal of this sensor.

Various methods can be conceived by automatically returning the bills wound on the second rotary member. One effective method is to use a belt-like spring having an automatic winding force as the guide belt. By winding the guide belt in such a manner that the automatic winding force (restoring force) of the belt-like spring will be exercised in a direction in which the guide belt is wound on the first rotary member, the guide belt is automatically rewound on the first rotary member when the motor for the second rotary member is reversely rotated with a result that the bills is fed out of the second rotary member and automatically returned. Another effective method is to additionally provide driver means for winding the guide belt on the first rotary member and actuate this driver means when the bills are to be returned or discharged. As the driver means, suitable means such as a spring, a motor exclusively used for this purpose or a clutch device for utilizing the motor for the second rotary member by switching connection of the motor can be employed.

The bill retention device according to the invention can be utilized not only for a bill acceptor of a vending machine or a leasing machine but advantageously for a bill delivery machine. Further, the bill retention device can not only be used instead of the prior art bill stocker in a bill acceptor but can be used side by side with the bill stocker such that the bill retention device is used as an escrow device for deposited bills and the bill stocker as a cash-box.

BRIEF DESCRIPTION OF THE DRAWINGS

In the accompanying drawings.

DESCRIPTION OF PREFERRED EMBODIMENTS

Figure 1:
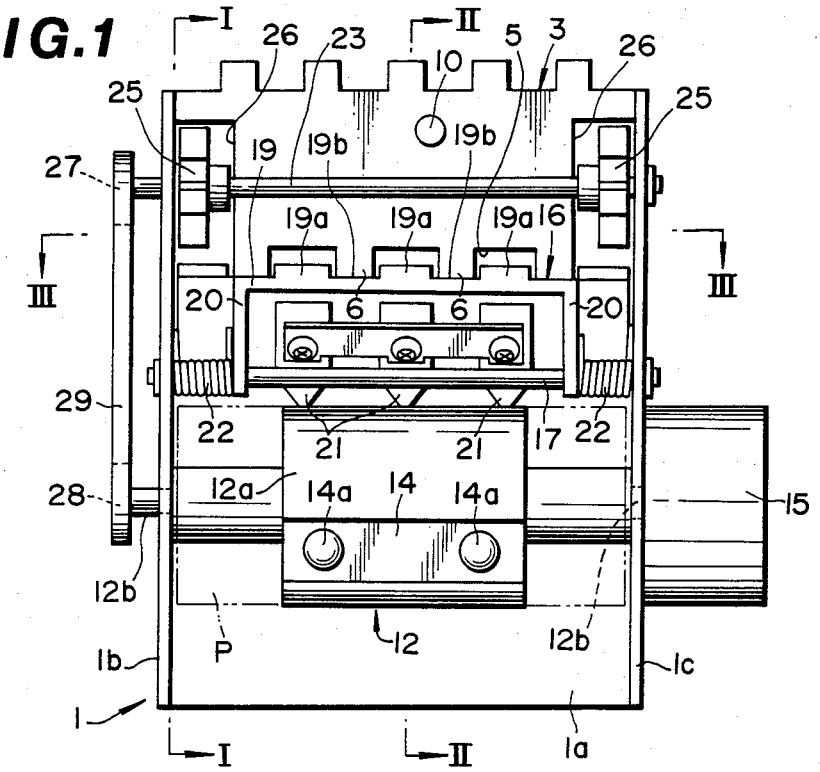
FIG. 1 is a front view of an embodiment of the bill retention device according to the invention.

The illustrated bill retention device according to the invention can compose a bill acceptor in combination with a bill selection device (not shown). Referring to FIGS. 1–5, a frame 1 of the bill retention device comprises a rear wall 1*a* and a pair of side walls 1*b*, 1*c*. In the upper portion of space defined between the side walls 1*b*, 1*c* are provided a pair of guide members 3, 4 which define a guide path 2 for receiving a bill P (See FIG. 3) passed from outside (e.g., the bill selection device) and introducing the bill inside the frame 1. The guide member 3 consists of a vertically disposed plate which is oblong in the horizontal direction of the frame 1. A plurality of recesses 5 are formed in the lower portion of the plate and a plurality of projections 6 between these recesses 5 extend downwardly with a slightly inward inclination. The guide member 4 which is disposed opposite to the guide member 3 has a horizontal portion 7 which is oblong in the horizontal direction of the frame 1, a vertical portion 8 which is provided integrally in front of the horizontal portion 7 and opposing the inside surface of the guide member 3 and defining the guide path 2 for permitting the bill P to pass through it, and a pair if integrally formed side portions 9, 9. A sensor 10 including a light-emitting element 10*a* and a light receiving element 10*b* and producing a signal upon detection of passing of the bill P is provided in the guide members 3, 4.

Figure 2:
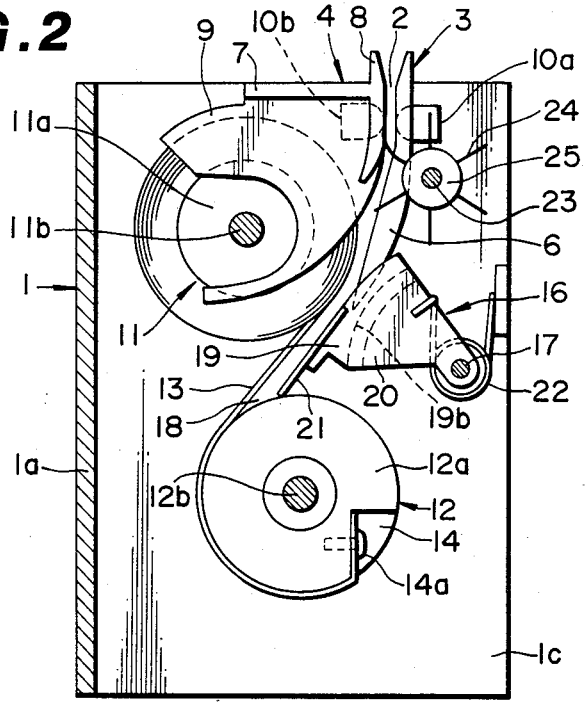
FIG. 2 is a sectional view of the embodiment taken along line I—I in FIG. 1.

In the upper portion of the space in the frame 1 is provided a first rotary member 11 including a winding drum 11*a* and shafts 11*b*, 11*b* projecting from the winding drum 11*a* and rotatably supported by the side walls 1*b*, 1*c* of the frame 1. The winding drum 11*a* is disposed between the side portions 9, 9 of the guide member 4. Below the first rotary member 11 in the lower portion of the space in the frame 1, there is provided, in parallel with the first rotary member 11, a second rotary member 12 including a winding drum 12*a* and shafts 12*b*, 12*b* projecting from the winding drum 12*a* and rotatably supported by the side walls 1*b*, 1*c* of the frame 1. A guide belt 13 composed of a suitable material, e.g., a synthetic resin sheet, is wound on the winding drum 11*a*. A free end of the guide belt 13 is wound on a part of the winding drum 12*a* in the shape of a letter S and fastened to a surface of a recessed portion 14 of the winding drum 12*a* by means of a screw 14*a* as shown in FIG. 2. A reversible electric motor 15 for driving the rotary member 11 is mounted on the outside surface of the frame. This motor 15 is controlled so that it will be driven in one direction by the detection signal from the sensor 10 upon detection of an incoming bill by the sensor 10 and stopped when the bill has passed. As the motor 15 is driven, the guide belt 13 is wound on the winding drum 12*a* of the second rotary member 12 and the first rotary member 11 is driven by the guide belt 13. Side edges of the guide belt 3 wound on the winding belt 11*a* of the first rotary member 11 are guided by the side portions 9, 9 so that deviation in the lateral direction is prevented. A guide member 16 which is swingably mounted on a rod 17 which is provided below the guide member 3 and supported at both ends thereof by the side walls 1*b*, 1*c* of the frame 1 serves to direct the bill P inserted in the guide path 2 to a position in which the guide belt 13 is wound on the winding drum 12*a* of the second rotary member 12. This guide member 16 includes an upper plate 19 and a pair of side plates 20, 20 which extend downwardly from both sides of the upper plate 19 and are supported at the lower end portions thereof by the rod 17. The upper plate 19 is formed in the upper surface thereof with projections 19*a* in positions opposite to the recesses 5 of the guide member 3 and with recesses 19*b* in positions opposite to the projections 6 of the guide member 3. Guide pieces 21 with tapered end portions made of elastic plates such as synthetic resin sheet or metal sheets are provided on the upper surface of the projections 19*a* and extending obliquely downwardly. Between the side plates 20, 20 and the frame 1 are provided helical springs 22 which constantly impart a rotating force to the guide member 16 so that the foremost end portions of the guide pieces 21 engage the winding drum 12*a* of the second rotary member 12 in the upper peripheral portion thereof with an optimum pressure. A rod 23 is rotatably supported at both ends thereof by the side walls 1*b*, 1*c* of the frame 1 near the outer surface of the guide member 3. Wheels 25 having flexible blades 24 radially extending therefrom are secured in both end portions of the rod 23. These wheels 25 are disposed in recesses 26 formed in both side portions of the guide member 3 and the blades 24 are disposed in the guide path 2 through the recesses 26. One end portion of the rod 23 projects outwardly through the side wall 1*b* of the frame 1 and a pulley 27 is mounted on the projecting end portion of the rod 23. One of the shafts 12*b*, 12*b* of the second rotary member 12 also projects outwardly through the side wall 1*b* and a pulley 28 is provided on the projecting portion of the shaft 12*b*. An endless belt 29 is stretched between the pair of pulleys 27 and 28.

Figure 3:
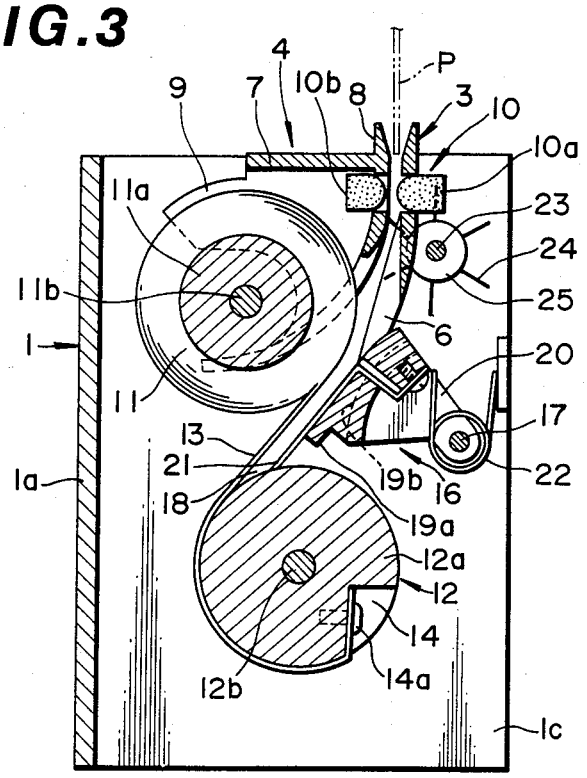
FIG. 3 is a sectional view showing the embodiment taken along line II—II in a state in which no bill is retained in the device.
Figure 4:
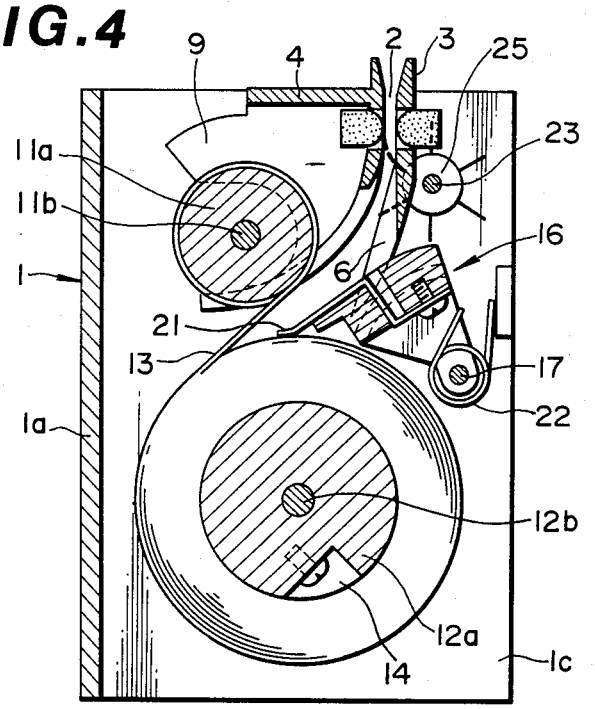
FIG. 4 is a sectional view showing the embodiment taken along line II—II in a state in which bills are retained.
Figure 5:
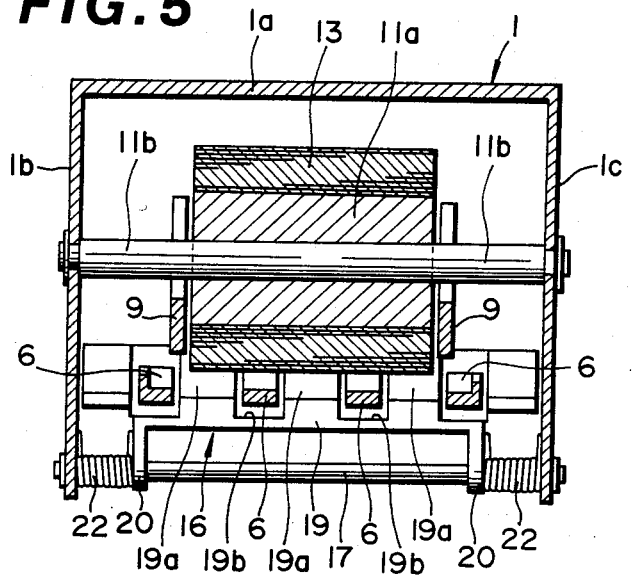
FIG. 5 is a sectional view of the embodiment taken along line III—III in FIG. 1.

Upon passing of the bill P into the guide path 2 from outside, the motor 15 is driven in response to the output of the sensor 10 and the second rotary member 12 thereby is rotated in a counterclockwise direction as viewed in FIG. 3 thereby causing the guide belt 13 to be wound on the second rotary member 12. The bill P passed into the guide path 2 by a feeding roller (not shown), for example, of the bill selection device is guided by the projections 6 of the guide member 3 and the upper surface of the guide member 3 and the lower edge of the bill P is directed to the winding position 18 of the guide belt 13. Then the bill P is held between the guide belt 13 and the winding drum 12*a* of the second rotary member 12 and wound on the winding drum 12*a* together with the guide belt 13. The winding operation finishes when the driving of the motor 15 has been stopped in response to the signal of the sensor 10 upon passing of the bill P through the guide path 2. Thus, a multiplicity of bills P are wound on the winding drum 12*a* of the second rotary member 12. As the second rotary member 12 is rotated by the motor 15, the rod 23 and the wheel 25 mounted thereon are also rotated and the blades 24 are caused to rub against the bills passing through the guide path 2. If, accordingly, a part of the bill P is folded, the folded portion is unfolded and the bill P is pushed inside by the blades 24.

When a predetermined number of bills have been wound on the second rotary member 12 (See FIG. 4), the frame 1 as a whole can be dismounted from the exchanging device and then the bills retained by the second rotary member 12 can be fed out by suitable means through the guide path 2. For example, the guide belt 13 is wound back on the first rotary member 11 by reversely rotating the motor or reversely rotating the first rotary member 11 by suitable means with a result that the bills are fed out of the second rotary member 12. Then the bills are let out of the guide path 2, being guided by the upper surface of the guide member 16 and the projections 6 of the guide member 3. The bill retention device, i.e., the entire frame 1, can be replaced in the manner of a cartridge relative to the exchanger main body.

In a case where the bill retention device including the frame 1 cannot be replaced in the manner of a cartridge or such replacement is difficult, means for automatically taking out the bills P retained in the rotary member 12 is required. Even in a case where the bill retention device including the frame 1 can be dismounted from the bill acceptor main body in the manner of a cartridge, the same requirement arises if bills once retained in the bill retention device is to be automatically returned to the bill selection device, i.e., the bill retention device is to function as an escrow device. For satisfying such requirement, the following embodiments are proposed.

Figure 6:
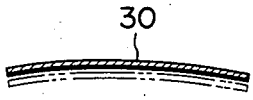
FIG. 6 is a cross sectional view of an example of a guide belt consisting of a constant output spring.

Known in the art is a constant output spring which is made of belt-like metal sheet such as a stainless steel sheet or a phosphor bronze sheet having a thickness of about 0.08 mm and is bent in the lateral direction and processed such that the spring will have an automatic winding force directed inwardly of the bent metal sheet. According to a modified embodiment of the invention, a constant output spring 30 which is made of a metal sheet such as a stainless steel sheet, bent in the lateral direction as shown in FIG. 6 and processed such that the spring will have an automatic winding force directed inwardly of the bent sheet is used as the guide belt 13. This spring 30 is wound on the winding drum 11*a* of the first rotary member 11 with one end thereof being secured to the winding drum 12*a* of the second rotary member 12 so as to assume the S shape.

As the second rotary member 12 is driven by a forward rotation of the motor 15, the second rotary member 12 is rotated in a counterclockwise direction as viewed in FIG. 3 to wind the constant output spring 30 (guide belt 13) against the force of the spring 30 to wind itself on the first rotary member 11 thereby causing the bills P to be wound on the second rotary member 12. Thus, a large number of bills are wound on the second rotary member 12 with the constant output spring 30 (guide belt 13) and retained thereon (See FIG. 4). If in this state the motor 15 is rotated in a reverse direction by manipulating a manual switch or in response to a bill discharging command electric signal, the constant output spring 30 (guide belt 13) is fed out of the second rotary member 12 toward the first rotary member 11 without being flexed and wound on the first rotary member 11 automatically with the aid of the winding force of the spring 30 (guide belt 13).

As the constant output spring 30 (guide belt 13) is fed out, the bills having been retained on the second rotary member 12 are taken out one by one from the second rotary member 12 and let out of the guide path 2 guided by the upper surface of the guide member 16 and the projections 6 of the guide member 3. Thus, all of the bills having been retained on the second rotary member 12 can be discharged from the bill retention device.

If an arrangement is made such that discharging of a single bill is detected by the sensor 10 and the reverse driving of the motor 15 thereby is stopped, discharging of a single bill can be realized. The bill retention device can therefore function as an escrow device which can return a deposited fbill if desired.

Figure 7:
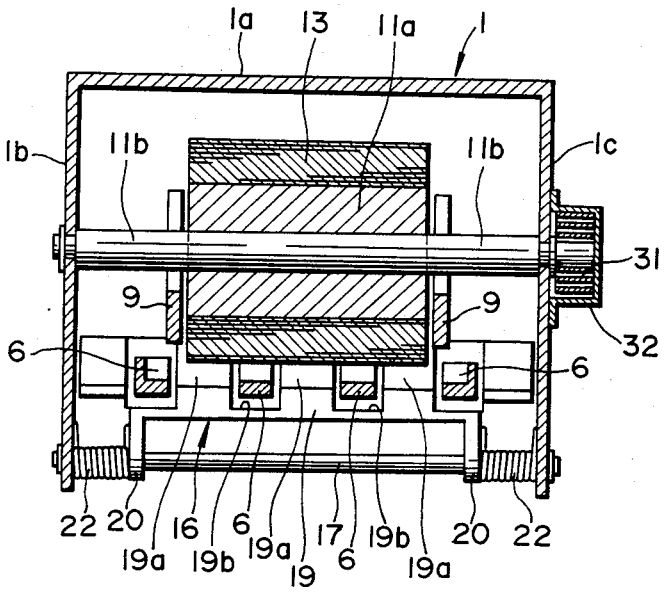
FIG. 7 is a sectional view of a modification of the embodiment shown in FIG. 5 in which a first rotary member is provided, with an energizing spring.

In the above described embodiment, the constant output spring 30 having an automatic winding force is utilized as the guide belt 13. Alternatively, as shown in FIG. 7, the guide belt 13 is made of a synthetic resin film, cloth or the like and an energizing spring 31 composed of a spirally wound constant output spring is disposed in a case 32 secured to the frame 1 with one end of the spring 31 being secured to the first rotary member and the other end thereof to the case 32 thereby imparting the first rotary member 11 with an energizing force in the winding direction. When the motor 15 is rotated forwardly, bills P are wound on the second rotary member 12 with the guide belt 13 and retained thereon. If the motor 15 is rotated reversely in this state, the first rotary member 11 winds up the guide belt 13 fed out of the second rotary member 12 in a tense state by the aid of the energizing force 31 and, as a result, the fed out bills P are discharged through the guide path 2, guided by the upper surface of the guide member 16 and the projections 6 of the guide member 3.

Figure 8:
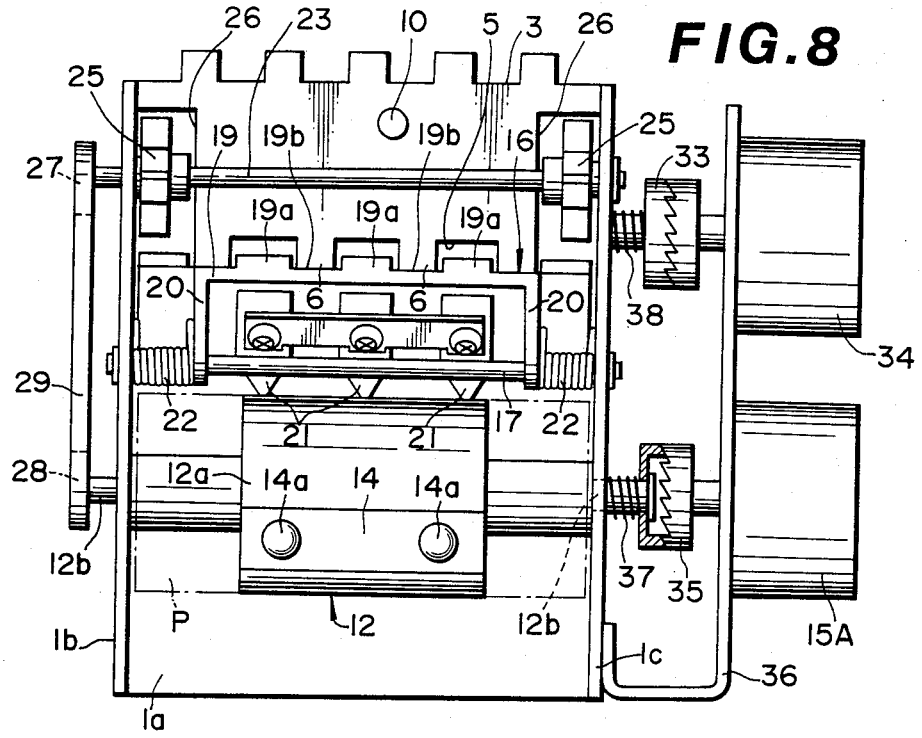
FIG. 8 is a front view of another embodiment of the bill retention device according to the invention.
Figure 9:
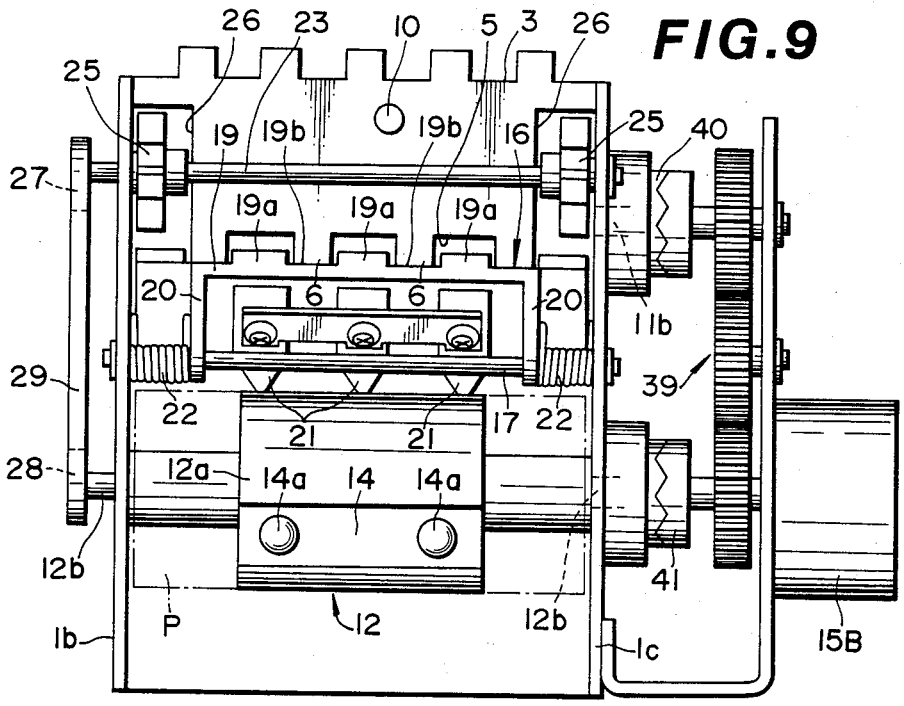
FIG. 9 is a front view of still another embodiment of the bill retention device according to the invention.

FIGS. 8 and 9 show modified embodiments in which a rotation power source is provided also for the first rotary member 11. In FIGS. 8 and 9, the same reference numerals as in FIGS. 1–7 designate the same component parts and detailed description of such component parts will be omitted. In the embodiment shown in FIG. 8, a first motor 34 is connected to the shaft 11*b* of the first rotary member 11 through a one-way clutch 33. A second motor 15A is connected to the shaft 12*b* of the second rotary member 12 through a one-way clutch 35. These motors 34 and 15A are mounted on an auxiliary side wall 36 which is attached to the side wall 1*c* of the frame 1. Clutch plates of the clutches 33 and 35 on the driven shaft side are respectively connected to the end portions of the shafts 11*b* and 12*b* such that they are fixed in the direction of rotation and movable in the axial direction and clutch plates on the driven shafts are pressed against clutch plates on drive shafts by means of springs 37 and 38.

For winding the bills P on the second rotary member 12 forwarded to the guide path 2 from outside (See FIG. 3), the motor 15A is driven in response to the output of the sensor 10 in the same manner as was previously described thereby rotating the second rotary member 12 in a counterclockwise direction as viewed in FIG. 3 through the clutch 35. This causes the guide belt 13 to be wound on the winding drum 12*a* of the second rotary member 12 and the first rotary member 11 to be rotated in a clockwise direction. In this case, the first motor 34 is driven through the one-way clutch 33 provided between the first rotary member 11 and the first motor 34 but this rotation of the first motor 34 exercises no adverse effect on the operation of the device.

For feeding out retained bills on the second rotary member 12 and discharging them through the guide path 2, the first motor 34 is driven. The driving of the first motor 34 is effected by manipulating a suitable manual switch or in response to a bill discharging command electric signal in the same manner as was previously described. The driving of the motor 34 causes the first rotary member 11 to be rotated in a counterclockwise direction as viewed in FIGS. 2, 3 and 4, the guide belt 13 to be wound on the first rotary member 11 and the second rotary member 12 to be rotated in a clockwise direction. As a result, the bills which have been wound on the second rotary member 11 with the guide belt 13 are fed one by one out of the second rotary member 12 and discharged through the guide path 2, guided by the upper surface of the guide member 16 and the projections 16 of the guide member 3.

If the first motor 34 is provided as described above, the guide belt 13 may be made of a material having no automatic winding force such as a synthetic resin sheet or cloth. The one-way clutches 33, 35 are provided for preventing transmission of reverse rotation of the motors 34 and 15A due to an erroneous operation to the rotary members 11 and 12 and therefore are not essential component parts for the invention.

A control similar to the one shown in FIG. 8 can be achieved also by a mechanism including a single motor 15B, a gear train 39 and electromagnetic clutches 40, 41 as shown in FIG. 9. For winding the guide belt 13 and bills on the second rotary member 12, the shaft of the motor 15B is connected to the shaft **12*b* of the second rotary member 12 by engaging the electromagnetic clutch 41 corresponding to the shaft 12*b*. For winding up the guide belt 13 on the first rotary member 13, the shaft of the motor 15B is connected to the shaft 11*b* of the first rotary member 11 by engaging the electromagnetic clutch 40 corresponding to the shaft 11*b*. The electromagnetic clutches 40 and 41** are so arranged that while one of them is engaged, the other is disengaged.

In the above described embodiments, the guide belt 13 is attached to the first and second rotary members 11 and 12 in such a manner that the guide belt 13 is stretched in the shape of S from the first rotary member 11 to the second rotary member 12 so that directions of rotation of the rotary members 11 and 12 are opposite to each other. The scope of the invention, however, is not limited to this construction but the guide belt 13 may be attached so that the rotary members 11 and 12 arerotated in the same direction.

We claim:

1. A bill retention device comprising:

a first rotary member including a guide belt and a first winding drum to which one end of said guide belt is secured, said guide belt being unwindably wound on said first winding drum;

a second rotary member disposed in parallel to said first rotary member and including a second winding drum to which the other end of said guide belt is secured, said guide belt being windable on said second winding drum;

a guide path for introducing bills sent from outside into the interior of said bill retention device; and guide means for guiding bills introduced through said guide path to a position in which said guide belt is wound on said second rotary member;

wherein the bills guided by said guide means are wound on said second rotary member with said guide belt as said second rotary member is rotated, thereby causing the bills to be retained in a state in which the bills are wound on said second rotary member with said guide belt;

said bill retention device further comprising a motor for rotating said second rotary member, said guide belt being wound on said second rotary member by rotation of said motor in a predetermined direction and said first rotary member being thereby driven to unwind said guide belt by a length wound on said second rotary member;

wherein said guide belt comprises a belt-like spring which is processed such that an automatic winding force is produced in a direction in which the guide belt is wound on said first rotary member and no automatic winding force is produced in a direction in which the guide belt is wound on said second rotary member and, when said guide belt is unwound from said second rotary member, said guide belt is automatically wound on said first rotary member by the automatic winding force.

2. A bill retention device comprising:

a first rotary member including a guide belt and a first winding drum to which one end of said guide belt is secured, said guide belt being unwindably wound on said first winding drum;

a second rotary member disposed in parallel to said first rotary member and including a second winding drum to which the other end of said guide belt is secured, said guide belt being windable on said second winding drum;

a guide path for introducing bills sent from outside into the interior of said bill retention device; and guide means for guiding bills introduced through said guide path to a position in which said guide belt is wound on said second rotary member;

wherein the bills guided by said guide means are wound on said second rotary member with said guide belt as said second rotary member is rotated, thereby causing the bills to be retained in a state in which the bills are wound on said second rotary member with said guide belt;

said bill retention device further comprising a motor for rotating said second rotary member, said guide belt being wound on said second rotary member by rotation of said motor in a predetermined direction and said first rotary member being thereby driven to unwind said guide belt by a length wound on said second rotary memer; and drive means for imparting a driving force to said first rotary member in the direction of winding said guide belt, said guide belt being wound on said first rotary member by said drive means when said guide belt is to be unwound from said second rotary member;

wherein said drive means comprises an energizing spring which constantly energizes said first rotary member in a direction in which said guide belt is wound, said motor is a reverisible motor and said guide belt is wound on said second rotary member against the force of said energizing spring during forward rotation of said motor whereas said guide belt is unwound from said second rotary member during reverse rotation of said motor and is wound on said first rotary member by the force of said energizing spring and the bills unwound from said second rotary member with said guide belt are fed back through said guide means and said guide path and automatically discharged from said bill retention device.

3. A bill retention device comprising:

a first rotary member including a guide belt, a shaft and a first winding drum carried on said shaft, one end of said guide belt being secured to said first winding drum and unwindably wound on said first winding drum;

a second rotary member disposed in parallel to said first rotary member and including a shaft and a second winding drum carried on said second member shaft, the other end of said guide belt being secured to said second winding drum and windable on said second winding drum;

a guide path for introducing bills sent from outside into the interior of said bill retention device; and guide means for guiding bills introduced through said guide path to a position in which said guide belt is wound on said second rotary member;

wherein the bills guided by said guide means are wound on said second rotary member with said guide belt as said second rotary member is rotated, thereby causing the bills to be retained in a state in which the bills are wound on said second rotary member with said guide belt;

said bill retention device further comprising a first motor having a shaft for rotating said second rotary member, said guide belt being wound on said second rotary member by rotation of said motor in a predetermined direction and said first rotary member being thereby driven to unwind said guide belt by a length wound on said second rotary member; and drive means for imparting a driving force to said first rotary member in the direction of winding of said guide belt, said guide belt being wound on said first rotary member by said drive means when said guide belt is to be unwound from said second rotary member;

wherein said drive means includes a second motor for rotating said first rotary member, and said guide belt is wound on said second rotary member and said first rotary member is driven to rotate when said motor for said second rotary member is rotated in a predetermined direction whereas said guide belt is wound on said first rotary member and said second rotary member is driven to unwind said guide belt from said second rotary member when said second motor is rotated in a predetermined direction and the bills unwound from said second rotary member with said guide belt are fed back through said guide means and said guide path and discharged automatically from said bill retention device.

4. A bill retention device comprising:

a first rotary member including a guide belt and a first winding drum to which one end of said guide belt is secured, said guide belt being unwindably wound on said first winding drum;

a second rotary member disposed in parallel to said first rotary member and including a second winding drum to which the other end of said guide belt is secured, said guide belt being windable on said second winding drum;

a guide path for introducing bills sent from outside into the interior of said bill retention device; and guide means for guiding bills introduced through said guide path to a position in which said guide belt is wound on said second rotary member;

wherein the bills guided by said guide means are wound on said second rotary member with said guide belt as said second rotary member is rotated, thereby causing the bills to be retained in a state in which the bills are wound on said second rotary member with said guide belt;

said guide means comprising a guide piece which extends along an extension of said guide path with a foremost end portion thereof abutting against the outer periphery of said second rotary member near a position in which said guide belt is wound on said second rotary member and a support member for swingably supporting said guide piece, said guide piece being moved in a pivotal movement in accordance with variation of the outer diameter of said second rotary member so that the foremost end portion thereof is constantly in abutting engagement against the outer periphery of said second rotary member.

5. A bill retention device as claimed in claim 4 further comprising a motor for rotating said second rotary member, said guide belt being wound on said second rotary member by rotation of said motor in a predetermined direction and said first rotary member being thereby driven to unwind said guide belt by a length wound on said second rotary member.

6. A bill retention device as defined in claim 5 further comprising a sensor provided in the vicinity of said guide path for detecting a bill passing through said guide path, the rotation of said motor being controlled in response to the output of said sensor.

7. A bill retention device as defined in claim 1 wherein said guide belt is composed of a constant output spring which is made of a belt-like metal sheet bent in the lateral direction and is processed such that the spring has an automatic winding force exercising inwardly of the bent surface, said guide belt is wound on said first rotary member in a direction in which the automatic winding force can be exercised, said guide belt is wound in the shape of S from said first rotary member to said second rotary member, said motor is a reversible motor and said guide belt is wound on said second rotary member against the automatic winding force of said guide belt during forward rotation of said motor whereas said guide belt is unwound from said second rotary member during reverse rotation of said motor and is wound on said first rotary member by the automatic winding force, and bills unwound from said second rotary member with said guide belt are fed back through said guide means and said guide path and discharged automatically from said bill retention device.

8. A bill retention device as claimed in claim 3 wherein said drive means includes a first clutch provided on said shaft of said first rotary member and transmission means for transmitting the rotation of said second motor to said first clutch, a second clutch is further provided between said shaft of said second rotary member and said shaft of said first motor, said second clutch is engaged and said first clutch is disengaged when a bill is to be received thereby transmitting rotation of said first motor to said second rotary member whereas said first clutch is engaged and said second clutch is disengaged when a bill is to be discharged thereby transmitting the rotation of said second motor to said first rotary member to wind said guide belt on said first rotary member, and the bills unwound from said second rotary member with said guide belt are fed back through said guide means and said guide path and discharged automatically from said bill retention device.

9. A bill retention device as defined in claim 1 wherein said guide belt is wound in the shape of S from said first rotary member to said second rotary member and said guide piece extends substantially in parallel to the portion of said guide belt extending from said first rotary member to said second rotary member, and the bills are moved from said guide path to said second rotary member or reversely, being guided between said guide belt portion and said guide piece.

10. A bill retention device as defined in claim 9 which further comprises a roller which is elastically pressed against the surface of a bill in said guide path and is rotated in association with the rotation of said second rotary member to assist conveying of the bill.

11. A bill retention device comprising:

a frame;

a guide belt;

first and second winding drums for carrying the guide belt, each drum being adapted to wind the guide belt as the other drum unwinds the guide belt;

mounting means for rotatably mounting each drum in parallel and aligned with the other drum so that the guide belt extends between the drums in a substantially straight line; and transport means for transporting bills between a position where the guide belt is wound on one of said drums and the exterior of the device;

said transport means including a guide member pivotally mounted to the frame and abutting the outer periphery of said one drum for providing a guide surface for the bills adjacent the position where the guide belt is wound on said one drum.

* * * * *